United States Patent [19]

Momoshima et al.

[11] Patent Number: 4,515,057

[45] Date of Patent: May 7, 1985

[54] MUSICAL SOUND WAVE GENERATING CIRCUIT FOR ELECTRONIC MUSICAL INSTRUMENT

[75] Inventors: Yukichi Momoshima; Nobuyuki Nagasaka, both of Tokyo, Japan

[73] Assignee: Kabushiki Kaisha Daini Seikosha, Tokyo, Japan

[21] Appl. No.: 458,477

[22] Filed: Jan. 17, 1983

[30] Foreign Application Priority Data

Jan. 21, 1982 [JP] Japan ..... 57-7894

[51] Int. Cl.[3] ..... G10F 1/00

[52] U.S. Cl. ..... 84/1.03; 84/1.28; 84/DIG. 12

[58] Field of Search ..... 84/1.03, 1.28, DIG. 12, 84/1.01, 1.24

[56] References Cited

U.S. PATENT DOCUMENTS 4,305,319 12/1981 Linn ..... 84/1.01

*Primary Examiner*—Forester W. Isen

*Attorney, Agent, or Firm*—Robert E. Burns; Emmanuel J. Lobato; Bruce L. Adams

[57] ABSTRACT

An electronic musical instrument having a keyboard has a sound wave-shape generating circuit comprised of a pitch ROM connected to the keyboard. A first selector is connected to the keyboard, and a second selector is connected to the pitch ROM. A drum rhythm sound pitch data generating circuit and a pitch forming circuit are each connected to the first and second selectors. A wave-shape memory and a noise rhythm sound forming circuit are each connected to the pitch forming circuit. A third selector is connected to the wave-shape memory and the noise rhythm sound forming circuit. An envelope counter is connected to the third selector and the output of the envelope counter is fed to an audio amplifier. In use, a play/rhythm switching signal is selectively applied to the first, second and third selectors so that both a drum rhythm sound and a noise rhythm sound can be generated using only the one wave-shape memory.

7 Claims, 2 Drawing Figures

MUSICAL SOUND WAVE GENERATING CIRCUIT FOR ELECTRONIC MUSICAL INSTRUMENT

BACKGROUND OF THE INVENTION

The present invention relates generally to a musical sound wave-shape generating circuit and more particularly to such circuits for generating the wave-shapes of rhythm musical instruments such as cymbal, drum, etc.

In the conventional type of musical sound wave-shape generating circuit, the musical sound wave-shape for a piano, organ, etc. is generated by an organ IC for simultaneously generating on multi-channels, and the other musical sound wave-shapes for other rhythm musical instrument like cymbal, drum, etc. are generated by an independent IC. Therefore, many parts including ICs are necessary and consequently, it is very difficult to reduce the manufacturing cost.

The object of the present invention is to provide a preferred musical sound wave-shape generating circuit for and electronic musical instrument which selectively generates a plurality of playing musical sound wave-shapes or rhythm musical sound wave-shapes by using the conventional organ IC and additive very small hardware.

BRIEF DESCRIPTION OF THE DRAWINGS

FIG. 1 shows a block diagram of a musical tone wave-shape generating circuit according to a preferred embodiment of the present invention. A musical sound generating circuit 1 is able to selectively generate a playing musical tone wave-shape of a piano, organ, etc. or a rhythm musical sound wave-shape of a cymbal, drum, etc, whereby it is able to generate eight tones of the playing and rhythm musical sound wave-shapes by eight-channels using the time-sharing system.

Figure 1:
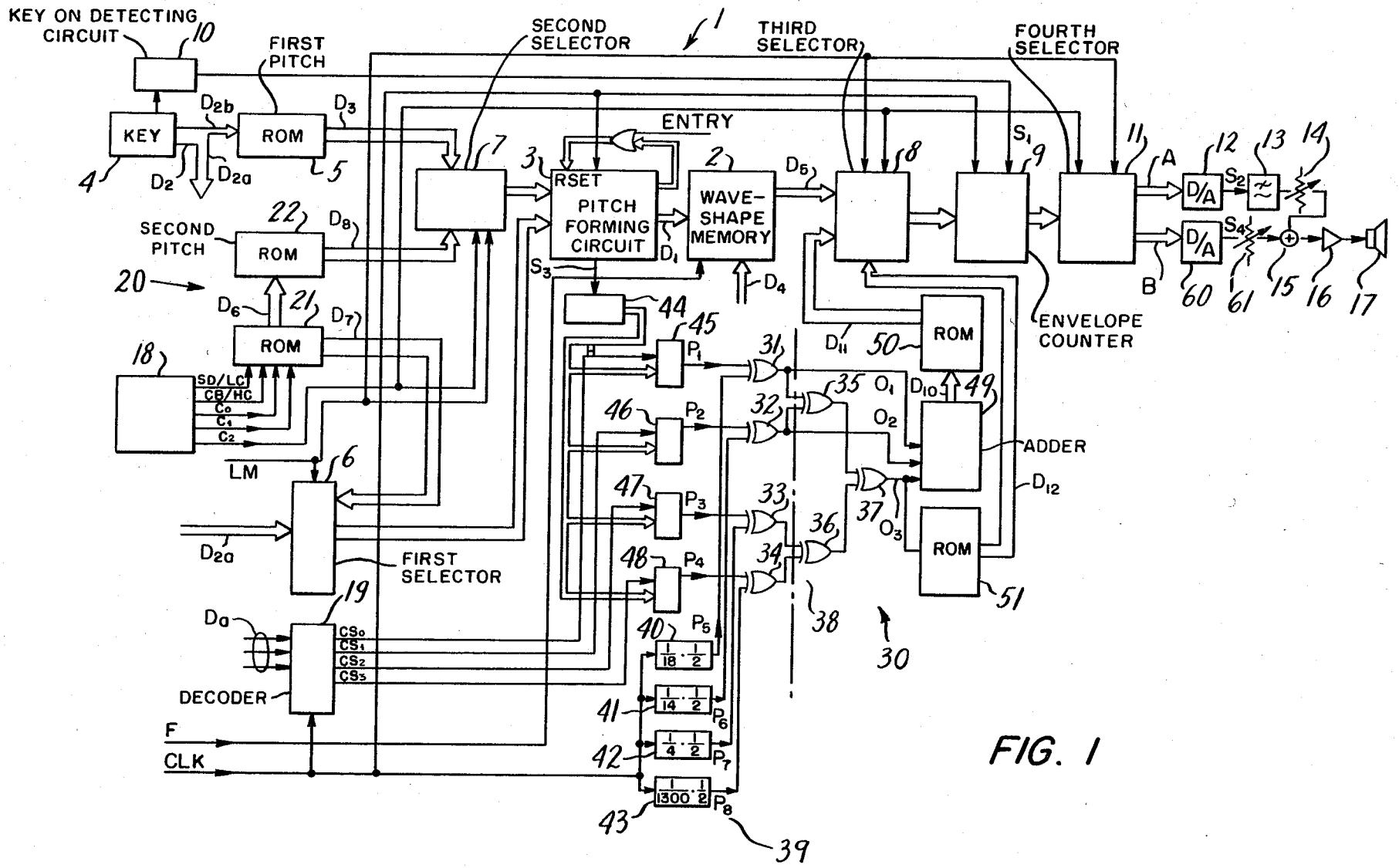
FIG. 1 shows a block diagram of the present invention.

The musical sound wave-shape generating circuit 1 has a wave-shape memory 2 for storing wave-shape data for basic one cycle waveforms of several musical sounds and a pitch forming circuit 3 which generates a maximum of eight channels of pitch data $D_1$ for reading the wave-shape data stored in the wave-shape memory 2.

Referring now to a construction in which said musical sound wave-shape generating circuit 1 is employed as a musical sound wave-shape generating circuit for a playing musical instrument, an octave data signal $D_2a$ and a note name data signal $D_2b$ which are composed by a key data signal $D_2$ from a key board 4 are applied to a first pitch ROM 5 and a first selector 6. The sound name data signal $D_2b$ is changed to a data signal $D_3$ which shows a pitch according to the contents of said data signal $D_2b$ by the first pitch ROM 5 and is applied to a second selector 7. A play/rhythm musical sound wave-shape switching signal LM is applied to each of the selectors 6 and 7. The level of said switching signal LM becomes "0" level in the case of a playing musical sound wave-shape generating mode whereby the selectors 6 and 7 are selected so as to be able to selectively generate a data signal $D_3$ and octave data signal $D_2a$. As a result, the data signals $D_2a$ and $D_3$ are applied to the pitch forming circuit 3 through the selectors 6 and 7, a maximum of eight channels of data are treated by a time sharing system according to a keyed condition of the key board 4, and a playing musical sound wave-shape data signal $D_5$ of a preferable playing musical instrument according to a musical instrument identification data signal $D_4$ is generated by a key operation pitch.

A playing musical sound wave-shape data signal $D_5$ which is obtained by the above noted means is applied to a third selector 8. The third selector 8 is controlled by the switching signal LM, and eight channels of musical sound wave-shape data signal $D_5$ are selectively generated when the switching signal LM is at a "0" level and the signal $D_5$ are applied to an envelope counter 9.

A key-on signal $S_1$ from a key-on detection circuit 10 and a clock signal CLK are applied to the envelope counter 9 whereby an envelope treatment of the musical sound wave-shape data generated from the third selector 8 is attained in response to an input of the key-on signal $S_1$. After that the musical note wave-shape data signal is applied to a D/A converter 12 through a fourth selector 11 which is selectively controlled by the switching signal LM and the signal is changed to an analogue musical note signal $S_2$. The analogue musical note signal $S_2$ is adjusted by a level controller 14 and after that the high frequency noise is eliminated by a low-pass filter 13 and the signal is applied to an amplifier 16 through an adder 15 and then to a speaker 17 which produce a playing musical sound.

The musical sound wave-shape generating circuit 1 has a drum rhythm sound pitch data generating circuit 20 and a noise rhythm sound forming circuit 30 so as to be able to generate a drum rhythm musical sound wave-shape for cobel, high-conga, etc. and a noise rhythm musical sound wave-shape for cymbal, high-hat, etc. In case of generating a rhythm musical sound wave-shape. The musical sound wave-shape generating circuit 1 is constructed so as to set the desired kind of musical instrument to the eight channels designated 0–7 channels respectively, and a musical wave-shape treatment corresponding to each selected musical instrument is carried out on the eight channels respectively. Further, in this embodiment, an assignment of musical instrument to channel is as shown in table-1.

TABLE 1

| | |
|---|---|
| CH-0 | cymbal (CY) |
| CH-1 | High-hat 1 ($HH_1$) |
| CH-2 | High-hat 2 ($HH_2$) |
| CH-3 | Snaire drum noise note (SDN) |
| CH-4 | Snaire drum (SDT), Crabes (CL) |
| CH-5 | Cobel (CB), High conga (HC) |
| CH-6 | Bass drum (BD) |
| CH-7 | Low conga (LC) |

According to the above noted table 1, channels CH-0–CH-3 are assigned to a noise musical instrument, and channels CH-4–CH-7 are set to a drum musical instrument.

A noise of the snare drum is treated by channel CH-3, and a repeated frequency thereof is treated by channel CH-4. Further, two kinds of musical instruments are set in channels CH-4 and CH-5, however, the two musical instruments are not simultaneously employed. Namely, snare drum is employed in Rock rhythm, crabes is employed in Latin rhythm. Further, cobel is employed in Samba rhythm, high conga is employed in other rhythms except said Samba rhythm.

A designation of the desired rhythm musical instrument is carried out by operation of a rhythm musical instrument selection switch 18, three-bits of channel data $C_0$–$C_2$ which indicate a present channel, and musical instrument code data SD/CL and CB/HC which show the designated musical instrument are respectively set on channels CH-4 and CH-5.

Further, the codes of channel data $C_0$–$C_2$ for each of the channels are shown as table 2.

| | $C_2$ | $C_1$ | $C_0$ |
|---|---|---|---|
| CH-0 | 0 | 0 | 0 |
| CH-1 | 0 | 0 | 1 |
| CH-2 | 0 | 1 | 0 |
| CH-3 | 0 | 1 | 1 |
| CH-4 | 1 | 0 | 0 |
| CH-5 | 1 | 0 | 1 |
| CH-6 | 1 | 1 | 0 |
| CH-7 | 1 | 1 | 1 |

The drum rhythm sound note pitch data generating circuit 20 generates a pitch data signal for reading the sine-wave data stored in the wave-shape memory 2 according to the pitch of the kind of drum rhythm musical instrument. The drum rhythm sound pitch data generating circuit 20 has a memory ROM 21 in which is stored a musical instrument code data SD/CL, CB/HC and channel data $C_0$ and $C_1$ input from the rhythm musical instrument selection switch 18. The memory ROM 21 generates an assigned data signal $D_6$ for indicating a set rhythm musical instrument for each of the channels CH-4–CH-7 and an octave data signal $D_7$ for a rhythm musical instrument in each of the channels, the octave data signal $D_7$ being applied to the first selector 6. On the other hand, the set data signal $D_6$ is applied to a second pitch memory ROM 22 which produces a data signal $D_8$ for indicating a reading pitch in response to a drum rhythm musical instrument set in said channels CH-4–CH-7 according to the set data signal $D_6$, and the data signal $D_8$ is applied to the second selector 7.

In case the musical sound wave-shape generating circuit 1 is operated as a rhythm musical sound wave-shape generating circuit, the switching signal LM level becomes "1", and the first selector 6 selectively generates a rhythm octave data signal $D_7$ in stead of a playing octave data signal $D_2a$ and applies said rhythm octave data signal $D_7$ to the pitch forming circuit 3, however, the switching signal LM level becomes "1" in the second selector 7 whereby it is inhibited to generate the data signal $D_3$. Further, the data signal $D_8$ as another input signal is applied to the second selector 7 and the pitch forming circuit 3 only during the time the channel data signal $C_2$ level is "1". Namely, in the case of the musical note wave-shape output mode of rhythm musical instrument, a data signal $D_8$ from the second pitch memory ROM 22 is applied to the pitch forming circuit 3 through the second selector 7 when the channel data signal $C_2$ level is "1" (in the case of the drum rhythm musical instrument mode). The pitch forming circuit 3 is constructed as an eight channel dividing circuit and divides the clock signal CLK by the input data and generates a reading clock signal of suitable cycle term in each of the channels CH-4–CH-7. A sine wave-shape data is read from the wave-shape memory 2 by a signal F when the musical sound wave-shape generating circuit 1 is operated so as to generate rhythm musical sound wave-shape data whereby a sine wave-data of the desired frequency determined in each of the channels CH-4–CH-7 is generated from the wave-shape memory 2. An output data from the wave-shape memory 2 becomes a musical tone wave-shape data having a drum rhythm musical instrument sound.

The third selector 8 applies wave-shape data selectively to the envelope counter 9 when the switching signal LM is "1" and the channel data $C_2$ is "1", and the wave-shape data is given a certain envelope shape and applied to the fourth selector 11. The fourth selector 11 switches the LM and $C_2$ signal levels and generates an input data only to an output line "A" when the LM and $C_2$ signal levels are both at level "1". Therefore, a musical sound wave shape data signal of a drum rhythm musical instrument is applied to a low-pass filter 13 through D/A converter 12, whereby the high frequency noise signal is elliminated, and a clear sound is generated from the speaker 17.

The noise sound forming circuit 30 forms a noise rhythm sound in channels CH0–CH3 as disclosed in the table-1 and is composed of a mixing circuit 38 which includes seven EX-OR gates 31–37 and a signal generator 39 which generates a plurality of signals which are mixed in the mixing circuit 38. The signal generator 39 divides the clock signal CLK and generates eight kinds of different frequency signals $P_1$–$P_8$ and is composed of dividers 40, 41, 42 and 43 for dividing the clock signal CLK to 36/1, 28/1, $\frac{1}{8}$ and 2600/1 and the pitch forming circuit 3.

As described above, the pitch forming circuit 3 is composed of a dividing circuit and the clock signal CLK is divided according to a certain dividing rate by using channels CH0–C-3 of the pitch forming circuit 3, to generate different frequency signals in each of the channels. A four channel time-sharing dividing signal $S_3$ generated from the pitch forming circuit 3 is divided by $\frac{1}{2}$ divider 44 and becomes a signal of $\frac{1}{2}$ duty cycle and is applied to four latch circuits 45–48. Further, channel signals CS0–CS3 generated by decoding a channel information signal $D_9$ by the decoder 19 are applied to the latch circuits 45–48, and a signal from $\frac{1}{2}$ divider 44 is latched during each channel timing, whereby signals $P_1$–$P_4$ are generated. The remaining signals P5–P8 are generated from the dividers 40–43. It is able to experimentaly determine the frequency of signals P1–P8, and in this embodiment, the signals P–P8 are selected in several 10 Hz–50 KHZ and are mixed in the mixing circuit 38, whereby three mixed output signals $O_1$, $O_2$ and $O_3$ are produced from the mixing circuit 38. The mixed output signals $O_1$, $O_2$ and $O_3$ are added in an adder 49, an added output data signal $D_{10}$ is changed to a log data signal $D_{11}$ by a log changing ROM 50 and is applied to the selector 8.

In case of dividing the signal by using the pitch forming circuit 3, a maximum frequency becomes $\frac{1}{8}$ of the clock signal CLK it can not divide except a divide of integer/1. Further, the highest frequency signal $O_3$ is changed to a log data signal $D_{12}$ by another log changing ROM 51 and is applied to the third selector 8. The data signal $D_{11}$ is used as a cymbal sound waveform and the data signal $D_{12}$ is used as a snare drum noise waveform. The third selector 8 selectively generates the data signals $D_{11}$ and $D_{12}$ instead of a data from the wave-shape memory 2 and applies these data signals $D_{11}$ and $D_{12}$ into the envelope counter 9. The envelope shape of said data signals $D_{11}$ and $D_{12}$ is determined by the envelope counter 9, whereby a musical wave-shape data as shown in first table 1 is generated in the channels CH-0–CH-3. The fourth selector 11 generates the input data in the output line B when the switching signal LM level is "1" and the $C_2$ level is "O". These musical sound wave-shape data of noise rhythm musical instruments are applied to D/A converter 60 and changed to an analogue musical sound signal $S_4$ and are applied to the adder 15 after arranged the level thereof is adjusted by an adjuster 61 whereby a musical sound is generated from the speaker 17. The fourth selector 11 separates the drum rhythm sound signal and noise rhythm sound signal since the noise rhythm sound signal is of very high frequency of 8000–10,000 HZ and not use a low pass filter cannot be used as such would produce different sound. The drum rhythm sound signal is composed of less than 2000 HZ and a low pass filter can be used since it is necessary to eliminate a noise factor. According to the separation of the above noted output system, a high noise factor is completely eliminated from the drum rhythm sound, the noise rhythm sound becomes the shape of a high sound, whereby a cymbal and high-hat sound are clearly generated as a natural musical instrument sound.

Figure 2:
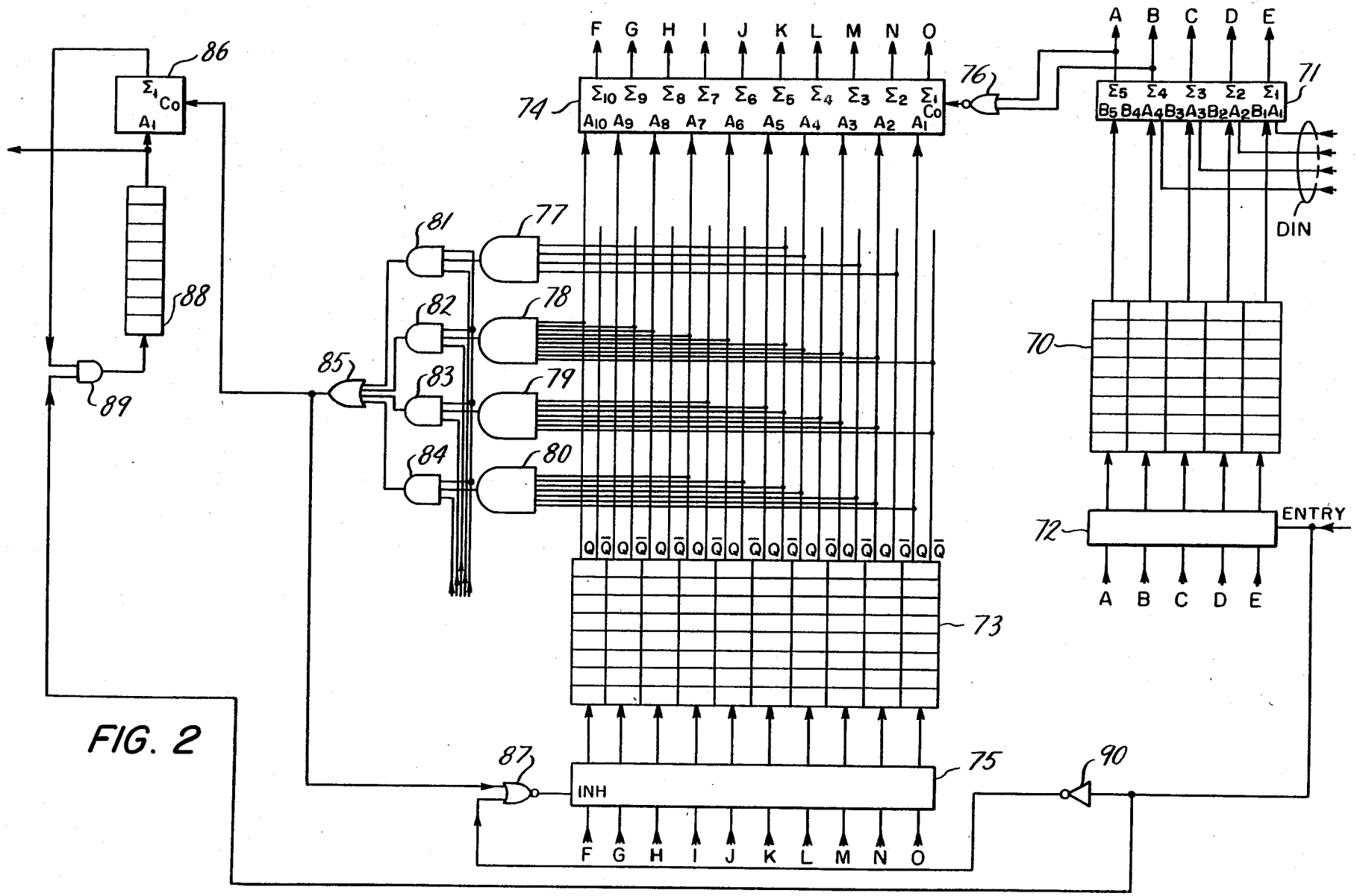
FIG. 2 shows a circuit diagram of the pitch forming circuit shown in block form in FIG. 1.

FIG. 2 shows one embodiment of the present invention for constructing a signal generator of the noise rhythm sound forming circuit 30 by using the pitch forming circuit 3. The pitch forming circuit 3 is composed of a 5 bit 8-channel shift register 70 and an adder 71 for adding output data from the shift register 70 to input data Din, said output from said adder 71 is applied to the shift register 70 again via AND-gate 72 which is controlled by an ENTRY-signal.

In the above noted construction, the input data Din relates to a certain dividing number made by input data of for the pitch forming circuit 3 and the added result is affected by the data Din value. The added result is returned to AND-gate 72 and is used as a data for indicating a data reading timing from the wave-shape memory 2, whereby a data is read from the wave-shape memory 2 according to the pitch data.

The pitch forming circuit 3 has another pair of dividing circuits composed of a 10 bit 8-channel shift register 73, adder 74 for adding "1" or "0" of the shift register 73 according to the output of the upper 2 bits of the adder 71 and AND-gate 75 connected to the input of the shift register 73. The output of the adder 74 is applied to the AND-gate 75. The dividing circuit divides the output of the adder 71 in $\frac{1}{2}$, $\frac{1}{4}$ . . . by the octave data, and the dividing circuit acts as a $\frac{1}{2}$ divider when the output of a NAND-gate 76 becomes "1".

By using this dividing function, four multi-input AND-gates 77, 78, 79 and 80 are connected to the output terminal of the shift register 73, the AND-gates 77–80 generate "1" when all of the inputs are "1". The output terminals of the AND-gates 77–80 are connected to AND-gates 81–84, the switching signal LM is respectively applied to the AND gates 81–84, and the channel signals SC0–SC3 from the decoder 19 in FIG. 1 are applied to the AND-gates 81–84. Therefore, when the switching signal LM is "1" and the corresponding channel signal is "1", some of the AND-gates 81–84 are opened. Further, the output level of the corresponding AND-gates is generated via the opened AND-gates. The outputs from the AND-gates 81–84 are applied to OR-gate 85, the output of the OR-gate 85 is directly applied to 1-bit adder 86 and is connected to an inhibit terminal 1NH of AND-gate 75 via NOR-gate 87. Each of the channel contents of the register 73 increase 1 by 1 every 1 cycle when the output level of the NOR-gate 76 is "1" and +1 addition is repeatedly executed by the adder 74, accordingly, the multi-input AND-gates 77–80 become "1" level when the channel contents corresponding to the shift register 73 became a certain value, whereby, the 1NH terminal becomes "0" level according to the opened AND-gate.

Therefore, the output from the adder 74 is not applied to the shift register 73, and a "0" level is set in the shift register 73. Namely, a clock signal is divided by the time-sharing mode in each of the channels CH0–CH3. A pulse from the OR-gate 85 is sequentially stored in 1 bit 8-channel shift-register 88 via the 1 bit adder 86. The $\frac{1}{2}$ dividing circuit 44 is composed of the adder 86 and shift register 88, whereby a divided signal of certain frequency is generated in the channels CH0–CH3 in a particular timing mode.

Further, it is possible to get a $\frac{1}{2}$ duty cycle by the $\frac{1}{2}$ dividing circuit 44. The ENTRY signal is applied to the AND-gate 72 and one input of a NAD-gate 89, an inverted $\overline{\text{ENTRY}}$ signal is applied to another input the said NOR-gate 87. The outputs of AND-gate 72 and shift register 70 become "0" level when the ENTRY signal becomes "0" level. At this time, the input data Din contents becomes "0" level, and the output of the NOR-gate 76 becomes "1" level. In the same way the contents of the shift registers 73 and 88 become "0", whereby the pitch forming circuit 3 is reset. The operation becomes a starting condition when the ENTRY signal is "1" level.

As the necessary signal generator for generating a noise rhythm musical instrument sound, 4-channels of the dividing circuit of the pitch forming circuit 3 and the dividing circuits 40–43 are employed, whereby it is possible to fully use the pitch forming circuit in case of generating a rhythm musical instrument sound.

According to the present invention, a playing musical sound wave-shape generating function and rhythm musical sound wave-shape generating function are provided and are easily selected by a simple selecting operation. Further, the two functions are accomplished by a common circuit construction, whereby the circuit construction becomes smaller thereby enabling the manufacture of an inexpensive musical sound wave-shape generating circuit.

We claim:

1. A musical instrument having a wave generating circuit comprising in combination: a keyboard having a plurality of keys; a first pitch ROM connected to said keyboard for determining a musical step; a first selector responsive to said keyboard; a second selector responsive to said first pitch ROM; a drum rhythm sound pitch data generating circuit connected as an input to both said first and second selectors; a pitch forming circuit responsive to both said first and second selectors; a wave-shape memory responsive to said pitch forming circuit; a noise rhythm sound forming circuit responsive to said pitch forming circuit and receptive of a clock signal during use of the wave generating circuit; a third selector responsive to both said wave-shape memory and said noise rhythm sound forming circuit; means for applying a play-rhythm musical sound wave-shape switching signal to said first, second and third selectors; an envelope counter responsive to said third selector; and audio amplifying means responsive to said envelope counter; whereby a drum rhythm of said drum rhythm sound pitch data generating circuit and a noise rhythm of said noise rhythm sound forming circuit are both generated using said one wave-shape memory.

2. A musical instrument according to claim 1; wherein the drum rhythm sound pitch data generating circuit comprises a memory ROM for storing musical instrument data, and a second pitch ROM connected to receive the data output from the memory ROM and connected to output data to the second selector.

3. A musical instrument according to claim 2; wherein the drum rhythm sound pitch data generating circuit includes a musical instrument selection switch connected to the memory ROM.

4. A musical sound wave-shape generating circuit for selectively generating musical sounds having wave-shapes representative of different kinds of musical instruments comprising: a wave-shape memory for storing wave-shape data representative of one cycle waveforms of plural musical sounds; a multi-channel pitch forming circuit connected to the wave-shape memory for producing pitch data signals on plural channels for reading the wave-shape data stored in the wave-shape memory; first rhythm sound pitch data generating means for generating a group of first pitch data signals corresponding to respective ones of a first group of musical instruments; second rhythm sound pitch data generating means for generating a group of second pitch data signals corresponding to respective ones of a second group of musical instruments which are different from the first group of musical instruments; an envelope counter for imparting an envelope shape to pitch data signals applied thereto; one selecting means for selectively applying the first pitch data signals to the pitch forming circuit to enable reading of the wave-shape data stored in the wave-shape memory according to the first pitch data signals; another selecting means for selectively applying either the wave-shaped first pitch data signals output from the wave-shape memory or the second pitch data signals to the envelope counter; and means connected to the envelope counter for converting the enveloped first and second pitch data signals output from the envelope counter into corresponding first and second groups of musical instrument sounds.

5. A musical sound wave-shape generating circuit according to claim 4; wherein the group of first pitch data signals correspond to respective drum rhythm sounds, and the group of second pitch data signals correspond to respective noise rhythm sounds.

6. A musical sound wave-shape generating circuit according to claim 5; wherein the second rhythm sound pitch data generating means includes means responsive to pitch data signals produced by said pitch forming circuit for determining the pitch of the second pitch data signals.

7. A musical sound wave-shape generating circuit according to claim 4; wherein the second rhythm sound pitch data generating means includes means responsive to pitch data signals produced by said pitch forming circuit for determining the pitch of the second pitch data signals.

* * * * *